US006929552B1

(12) United States Patent
Hargabus

(10) Patent No.: US 6,929,552 B1
(45) Date of Patent: Aug. 16, 2005

(54) QUICK EXCHANGE INFINITY MIRROR DISPLAY APPARATUS AND METHOD

(76) Inventor: Patrick Allen Hargabus, 816 Locklear Ave., Sarasota, FL (US) 34237

( * ) Notice: Subject to any disclaimer, the term of this patent is extended or adjusted under 35 U.S.C. 154(b) by 0 days.

(21) Appl. No.: 10/806,551

(22) Filed: Mar. 23, 2004

Related U.S. Application Data

(63) Continuation-in-part of application No. 09/677,705, filed on Sep. 30, 2000, now Pat. No. 6,709,339, which is a continuation-in-part of application No. 09/375,894, filed on Aug. 17, 1999, now abandoned.

(51) Int. Cl.[7] ..... A63J 5/02
(52) U.S. Cl. ..... 472/61; 472/63; 40/541
(58) Field of Search ..... 472/59, 61, 63; 40/541, 446, 452, 489, 582

(56) References Cited

U.S. PATENT DOCUMENTS 1,219,731 A * 3/1917 Hall ..... 40/443
1,880,026 A * 9/1932 Singerman ..... 434/102
1,939,597 A * 12/1933 Merrill, Jr. ..... 352/102
1,981,923 A * 11/1934 Miller ..... 40/438
2,056,396 A * 10/1936 Gorrie ..... 40/219
4,761,004 A * 8/1988 Hargabus ..... 472/63
5,465,909 A * 11/1995 Roth ..... 232/1 D
5,787,618 A * 8/1998 Mullis ..... 40/219

* cited by examiner

*Primary Examiner*—Kien Nguyen
(74) *Attorney, Agent, or Firm*—Dorothy S. Morse

(57) ABSTRACT

An infinity mirror display apparatus, and method of manufacture, which allows private and commercial users to rapidly trade out favored display objects to create different infinity display effects for continued viewer interest and enjoyment. The apparatus comprises a housing having a stationary base member and an easily removable cover which together define an enclosed interior space, at least two reflective surfaces positioned adjacent to the interior space with at least one of the surfaces being partially reflective, and at least one illumination source communicating with the interior space. The cover can be partially or totally removed from the stationary member during display object exchange. The apparatus can be wall-mounted for front and/or side viewing of the infinity mirror effect, or it can be table-mounted with multiple partially reflective surfaces for a full 360° view of the infinity mirror effect created by one or more illuminated display objects.

20 Claims, 9 Drawing Sheets

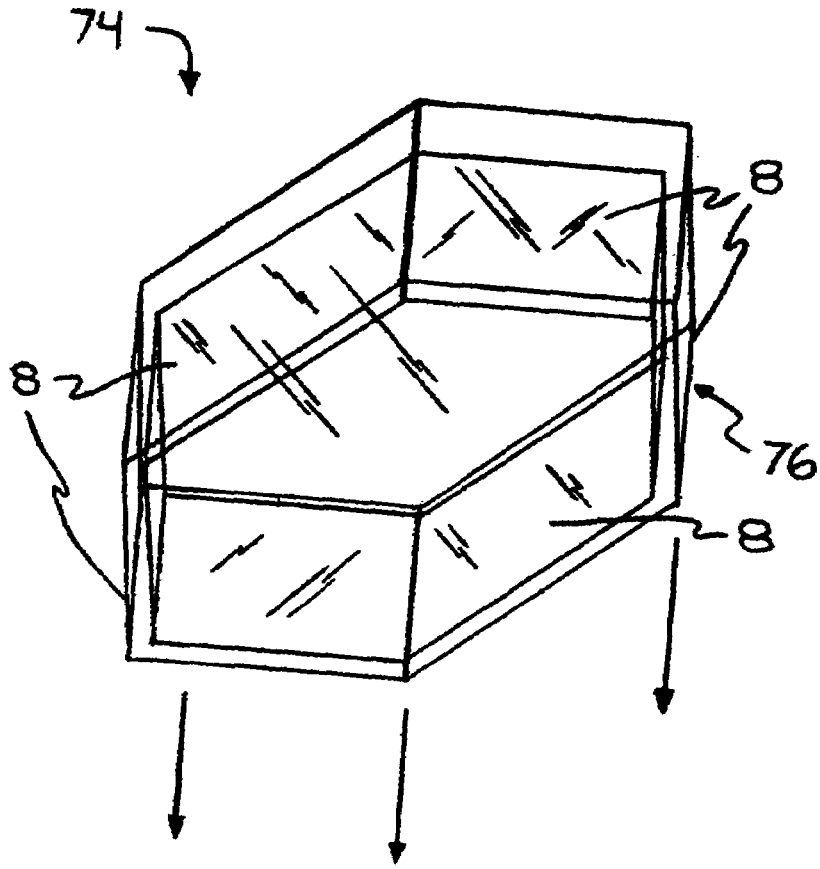
Fig. 9
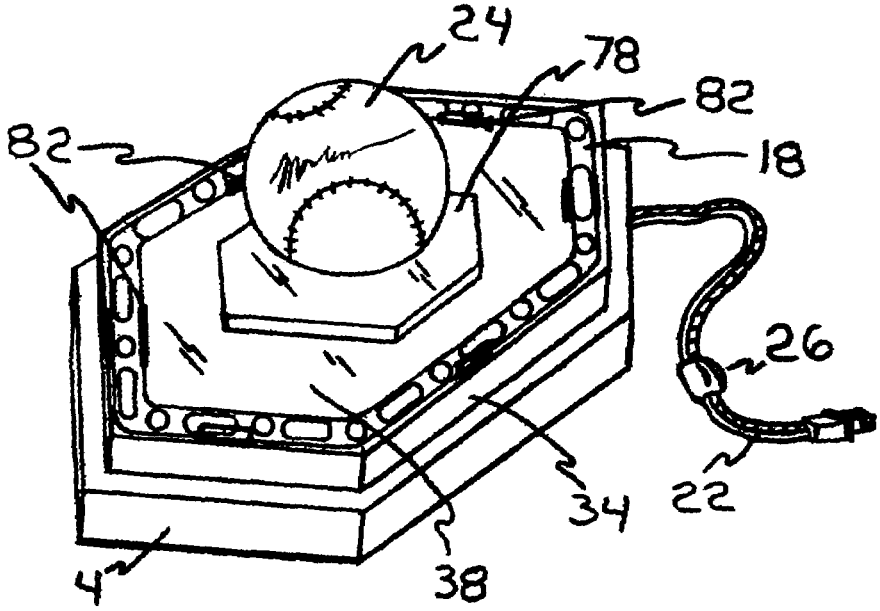

QUICK EXCHANGE INFINITY MIRROR DISPLAY APPARATUS AND METHOD

CROSS REFERENCES TO RELATED PATENT APPLICATIONS

This is a continuation-in-part utility patent application based upon the invention disclosed in U.S. patent application Ser. No. 09/677,705 to the same inventor, filed Sep. 30, 2000, and has been allowed to issue as U.S. Pat. No. 6,709,339, which is a continuation-in-part utility patent application based upon the invention disclosed in U.S. patent application Ser. No. 09/375,894 to the same inventor, filed Aug. 17, 1999, now abandoned, and benefit of the previous co-pending patent applications is requested herein.

BACKGROUND

1. Field of Invention

This invention relates to devices for creating infinity mirror display effects, specifically to an openable infinity mirror display case or apparatus, and a method for its manufacture, which has a base member that remains stationary during use, an easily removable cover that is placed during use in a closed position against the base member to define an interior space, an illumination means communicating with the interior space, and at least one display object placed between the cover and the base member with the illumination means lighting it, where the cover or base member together comprising two or more at least partially mirrored surfaces, or otherwise partially reflective surfaces, in opposed positions whereby when the cover is placed into its closed position and an observer viewing display objects in the interior space through at least one of the partially mirrored or partially reflecting surfaces will see at least one row of alternating front and rear reflected images of each display object used extending rearwardly from it. When three or more partially reflecting surfaces are used at right angles to one another, with a fully reflective surface connected parallel to and behind the center one of the partially reflective surfaces, and an observer looks only through the center surface, multiple rows of reflected images that contain alternating front and rear images of the display object also appear parallel to and on both sides of the row of reflected images extending directly behind the display object. In the alternative, when an observer looks at the display object or objects within the interior space from the substantially perpendicular connection between the center partially reflective surface and the one to its left, the observer will view multiple parallel rows of reflected images (alternatively front and rear reflected images) extending rearwardly from the display object and laterally to the right. In contrast, when an observer looks at the display object or objects within the interior space from the substantially perpendicular connection between the center partially reflective surface and the one to its right, the observer will view multiple parallel rows of reflected images (alternatively front and rear reflected images) extending rearwardly from the display object and laterally to the left. The intensity of display object illumination and the amount of light transmission possible through the partially reflective viewing surfaces determines the number of reflected images an observer will see, and the capability for the present invention infinity display apparatus cover to be moved away from its closed position sufficiently for new display objects to be readily placed within the interior spaced defined by the cover and base member allows the infinity mirror display effect to be continually updated and renewed to maintain viewer interest. Optionally, a variety of support surfaces and support devices may be employed within the housing for securely positioning a selection of display objects in different locations within the housing so that the display objects can be used without modification or alteration. Also, different types of illuminations sources, including multiple light sources, are contemplated for use in illuminating the display objects. Prompt display object exchange is important for private and commercial applications, such as but not limited to creating an infinity mirror display effect for a hobbyist having a grouping of collectible objects small enough to be placed within the interior space, such as die-cast metal cars, so that when the hobbyist makes additions to his or her collection, the new acquisitions can easily and readily be displayed; for point-of-sale displays in commerce that direct customers' attention to newly received merchandise; for commercial use by establishments such as restaurants, bars, night clubs, hotels, and antique shops where varying numbers of objects can be featured on a rotating basis for general public viewing, to create an interesting and exciting work environment for attracting and maintaining good employees, to create public interest in a particular topic, to create an interest in the establishment for attracting new and repeat customers, to provide a basis for conversation among existing customers, and to maintain consumer and public interest in the establishment; for dust-free enhanced display of trophies and awards by individuals and organizations so that new acquisitions can be easily placed along side of those earlier received; for enhanced display of autographed items such as baseballs or baseball cards with the possibility of quick-exchange of one item for another whenever the owner desires; for the opportunity for enhanced display of any currently favored personal treasures or art objects with the opportunity at any time for the owner to easily and rapidly exchange one or more of them for a newly favored treasure or art object to create an ever changing variety of infinity mirror display effects for observer enjoyment; and for addition as an incorporated part of larger devices, to enhance their marketability, eye appeal, and usage by the public, such as use with juke boxes and the like, as well as skill/gaming devices including those that allow a player to pay a fee and them employ a crane to select one object among a grouping or various sized objects, some more valuable than others, with the present invention providing the receptacle into which the successfully selected object is displayed prior to being released to the player, wherein the present invention would add to the visual entertainment of the player and perhaps assist in enticing him or her to play again.

2. Description of Related Art

The infinity mirror effect is a principle disclosed in U.S. Pat. No. 4,761,004 to Hargabus (1988) and various other patents. Through the use of a mirror or other partially reflective surface positioned between a viewer and a totally reflective surface, and when the two reflective surfaces are oriented approximately parallel to one another, illuminated objects placed between the two reflective surfaces and viewed from any direction other than a straight-forward position will be observed to have multiple, spaced-apart reflections extending rearwardly therefrom. Differing effects can be created by placing one of the reflecting surfaces at an oblique angle relative to the other, and by adding more partially reflective surfaces. The infinity mirror display effect will be composed of multiple, alternating front and back, spaced-apart reflections extending rearwardly from each display object used with a grouping of reflective surfaces able to create the effect, with each newly repeated image being slightly smaller and diminished in brightness when compared to the next adjacent image. One disadvantage of prior art infinity display devices is that once a three-dimensional display object is placed in its operative position relative to the mirrors, it is not easily exchanged for another. This limits the use of prior art devices for display of collectibles and other favored objects for which new acquisitions are periodically being made. Also limited is the ease in which new visual effects can be created by the exchange of a previous collection of objects for one or more new objects. The present invention provides several alternative embodiments for creating an infinity mirror display apparatus that can be effectively used for the display of multiple three-dimensional objects, and then permit the nearly instantaneous exchange or addition of displayed objects, even those requiring a suspended means of support for best viewing. No device is known that has all of the advantages of the present invention.

BRIEF SUMMARY OF THE INVENTION—OBJECTS AND ADVANTAGES

The primary object of this invention is to provide an infinity mirror display apparatus configured for displaying multiple spaced-apart reflections extending rearwardly and perhaps also laterally from one or more illuminated display objects positioned in the interior space defined between a stationary base member and a removable cover, and which is adapted to permit nearly instantaneous access to the interior space so that three-dimensional display objects can be quickly and easily added and removed therefrom. It is also an object of this invention to provide an infinity mirror display apparatus that can remain in its mounted position during display object exchange or addition. A further object of this invention is to provide an infinity mirror display apparatus that includes multi-sided covers. It is also an object of this invention to provide an infinity mirror display apparatus in which the display objects can be freely exchanged and do not require any permanent modification or alteration for secure positioning within the housing. A further object of this invention is to provide an infinity mirror display apparatus that permits rapid and easy access to its interior space for nearly instantaneous removal or addition of display objects without disturbing other objects already positioned for display within the housing. It is also an object of this invention to provide an infinity mirror display apparatus having light sources that can be positioned anywhere that communicates with the interior space of the housing, including above or below a display object support, as well as in any direction or orientation relative to display objects that are suspended within the interior space, in direct contact with the bottom interior surface of the stationary base member, or positioned upon a display support.

As described herein, properly manufactured and used, the present invention infinity mirror display apparatus would enable those having a selection of objects for infinity effect display to be able to display one or more of them at a time, or in succession, in a variety of different combinations within the closed interior spaced of a housing defined by a stationary base member and a complementary cover in its closed position against the base member. Its easily-opened hinged, sliding, or detachable cover would comprise at least one partially reflective mirrored surface, or other partially reflective surface, through which a viewer would observe illuminated display objects and the multiple reflections produced rearwardly, and perhaps also laterally, therefrom that create the infinity mirror display effect. A second mirrored or other reflective surface that is either a partially or totally reflective surface, is positioned within or adjacent to the interior space behind the object or objects intended for display, remote from the viewer. As soon as the display objects become illuminated by a light source communicating with the interior space, the infinity mirror display effect is created. When the openable cover comprises the partially reflective surface used by an observer to view the infinity display effect, the cover must be closed to see the multiple images. However, when the openable cover is positioned above the partially reflective surface used by an observer to view the infinity display effect, multiple images can be seen even while the cover is open and display objects are being exchanged. Placement of the removable cover into its fully opened position, or one of a plurality of partially opened positions sufficient to allow passage of the largest display object targeted for exchange, permits rapid and easy access to the interior space of the housing for nearly instantaneous removal and/or addition of selected display objects, or prompt optional replacement of all display objects within the housing. Rapid opening of the cover can be accomplished through use of one or more hinges on any perimeter edge of the stationary base member, a perimeter groove in the stationary base member that allows the associated cover to slide within the groove between opened and closed positions, or by easily lifting the cover vertically away from its associated stationary base member. Since the cover is easily removed and placed into its fully opened position, or one of a plurality of partially opened positions that allow passage of the largest display object targeted for exchange, display objects can be quickly added or removed from the interior space of the housing without having to dismantle the stationary base member or cover, disturb the stationary base member from its mounted position, and without disturbing other objects already positioned for display within the interior space of the housing. Since the housing would not need to be rotated or positioned on its side for access to its interior space, display objects do not require any permanent modification or alteration for secure positioning within the housing and can be freely and instantaneously lifted from a display position for exchange. Also, since the housing would not need to be rotated or positioned on its side for access to its interior space, other objects already positioned for display within the housing are not disturbed when selected display objects are removed and/or when new display objects are added to a collection of objects already on display within the housing. Further, the display objects can be mounted in a variety of positions within the infinity mirror display apparatus housing, such as through use of suction cups or a bonded connection to one or more of the partially reflective surfaces in the cover employed by an observer to view the infinity display effect, one or more transparent or translucent movable support members placed directly upon the bottom interior surface of the housing, flexible filamentous materials suspended from anchoring devices such as hooks or rings supported by the top interior surface of the stationary base member or a multiple-sided cover, and elevated support members detachably and adjustably connected to peg holes formed in or attached to the vertically extending walls of a stationary base member or a multiple-sided cover. As a result, the light sources used to illuminate the diversely positioned display objects can also be positioned within any part of the housing and in any direction or orientation relative to the display objects, often providing illumination from below. Also, the size, number, and orientation of the reflective surfaces relative to one another can be varied, and although a more uniform infinity display effect is created when there is a close positioning of display object and reflective or partially reflective surface, interesting infinity display effects can also be created when more than two partially reflective surfaces are used and when reflective surfaces are positioned at oblique angles relative to one another. Therefore the configuration and dimensions of the stationary base member and cover are not limited as long as together they provide a means of enclosed support for all of the reflective surfaces selected for use, as well as an enclosed interior space of sufficient dimension for housing the maximum number of objects intended for simultaneous display and the amount of illumination needed to create a pleasing infinity display effect therewith. As a result, it is contemplated that the size of a housing used in the present invention would depend upon several factors such as but not limited to the cost of the materials used for its construction, the size and decor of the room where it would be used, and whether it would be wall-mounted or table-mounted. Further, when restricted access to one or more display objects within the interior space is desired, such as in a commercial application where the display items are highly desired or valuable, it is contemplated for the present invention to comprise a locking device that would prevent unauthorized separation of the cover from the stationary base member.

The description herein provides the preferred embodiments of the present invention but should not be construed as limiting the scope of the infinity mirror display apparatus. For example, variations in the length, width, and thickness dimensions of the stationary base member and its complementary cover; the size of the interior space defined by the stationary base member and its complementary cover; the total surface area of each of the reflective or partially reflective surfaces used to create the infinity display effect relative to the others; the type of locking means optionally used between the cover and the stationary base member to prevent unauthorized access to the interior space; and the means used to securely position display objects within the interior space of the housing other than those shown and described herein may be incorporated into the present invention. Thus the scope of the present invention should be determined by the appended claims and their legal equivalents, rather than the examples given.

BRIEF DESCRIPTION OF THE SEVERAL VIEWS OF THE DRAWINGS

FIG. 9 is a front perspective view of an eighth preferred embodiment of the present invention having a hexagonal housing with a substantially planar platform-like stationary base member and display support with a transparent or translucent top surface positioned above the stationary base member, a display object being supported by a movable support member centrally atop the display support, multiple lights positioned under the perimeter of the display support, and a box-like cover that can be vertically lifted from the stationary base member to give access to the interior space defined by the stationary base member and the cover, the cover being poised over the stationary base member in an open position allowing display object exchange, the cover comprising adjoining frameless partially reflective surfaces.

DETAILED DESCRIPTION OF THE INVENTION

Figure 10:
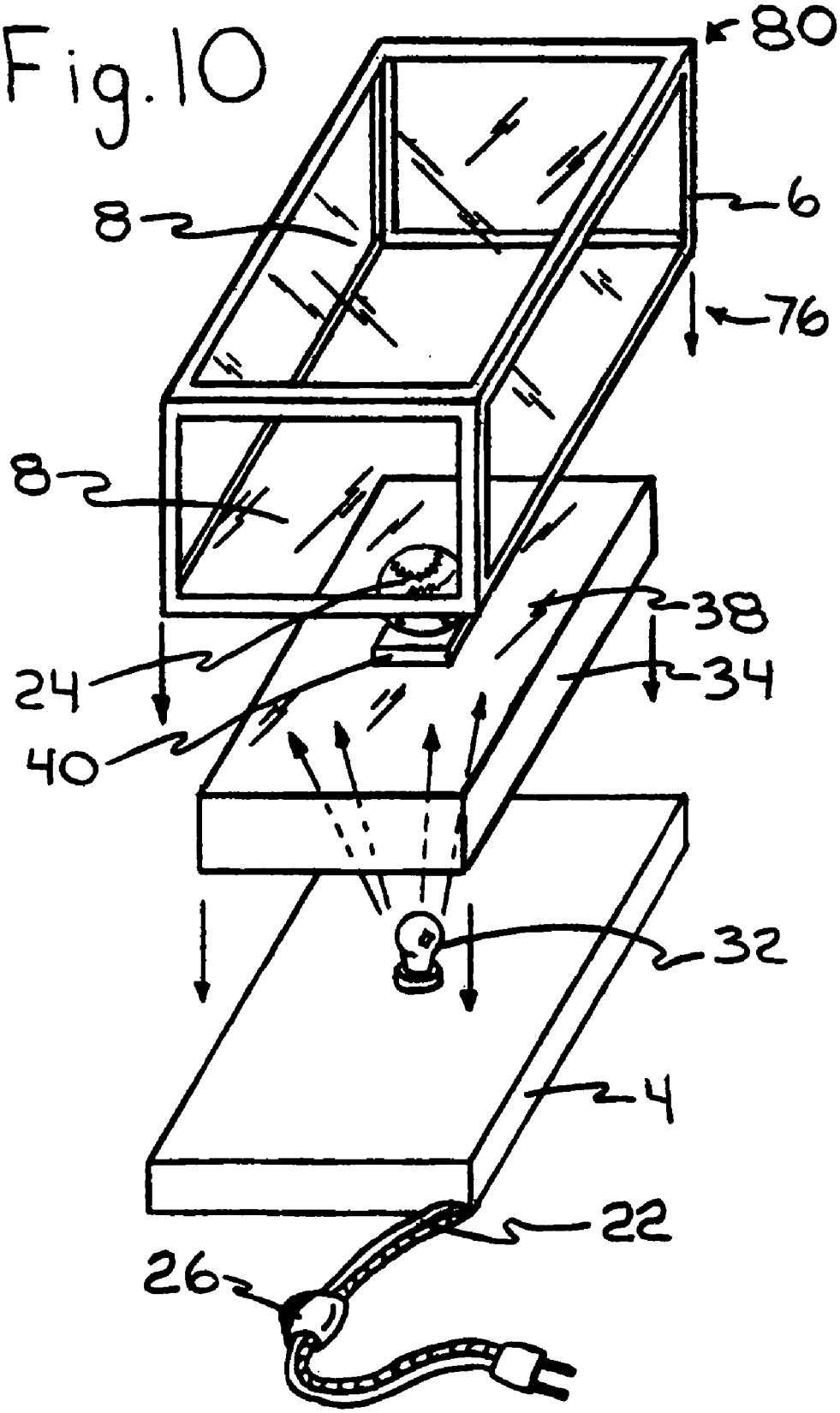
FIG. 10 is a front perspective view of a ninth preferred embodiment of the present invention having a rectangular housing with a substantially planar platform-like stationary base member and a light source attached through the upper surface of the stationary base member, a display support having a transparent or translucent top surface poised above the stationary base member, a display object being supported by a movable support member centrally atop the transparent or translucent top surface of the display support, and a box-like cover that is vertically lifted from the stationary base member to give access to the interior space defined by the stationary base member and the cover, the cover being poised over the stationary base member in an open position allowing display object exchange, the cover comprising adjoining partially reflective surfaces each supported by a frame.
Figure 11:
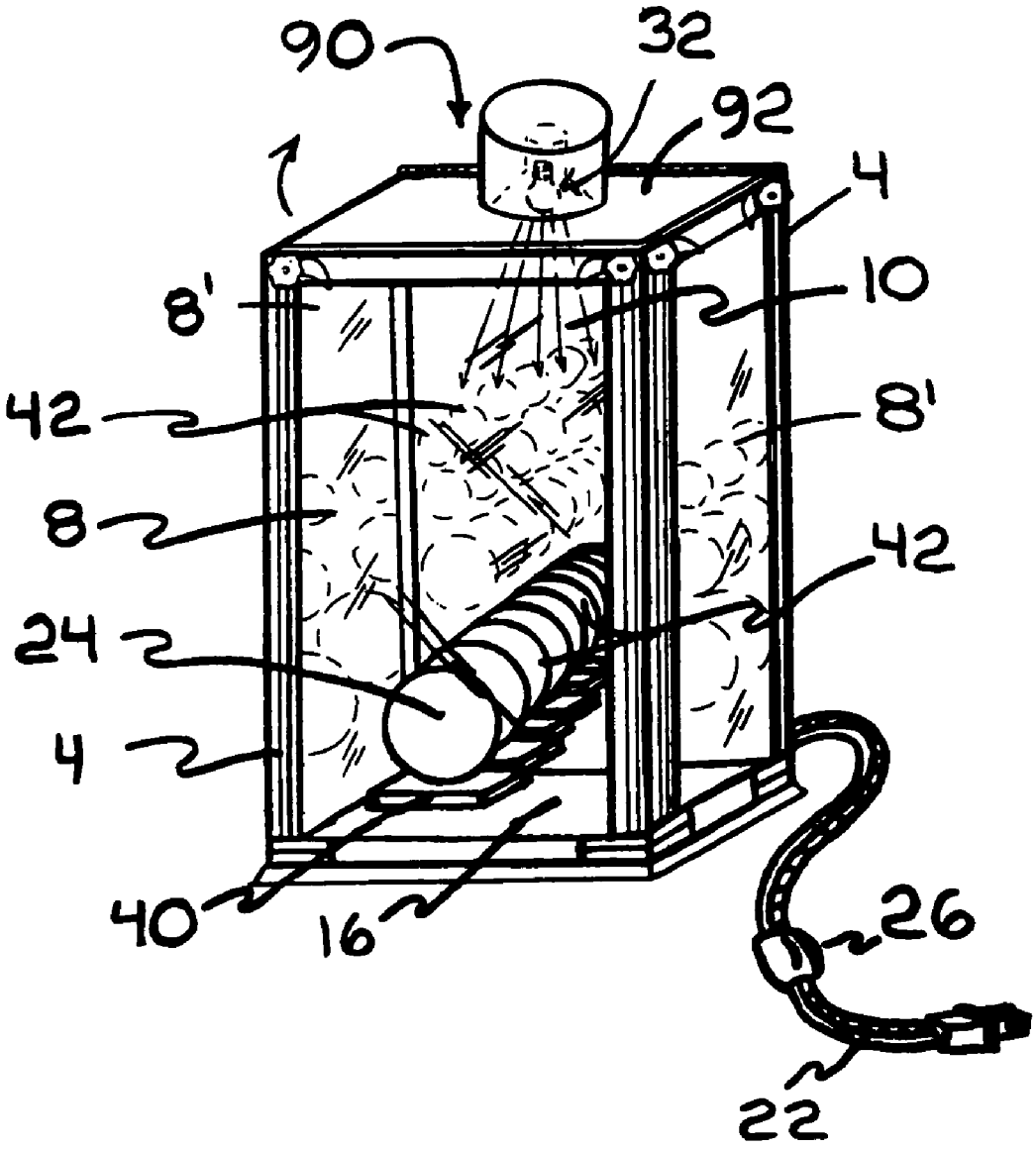
FIG. 11 is a front view of a tenth preferred embodiment of the present invention having a rectangular housing, a light source attached through the upper surface of the stationary base member, and a hinged cover that lifts vertically upward from the stationary base member to give access to the interior space defined by the stationary base member and the cover, with an upwardly directed arrow showing that the cover is vertically openable from the closed position shown.
Figure 12:
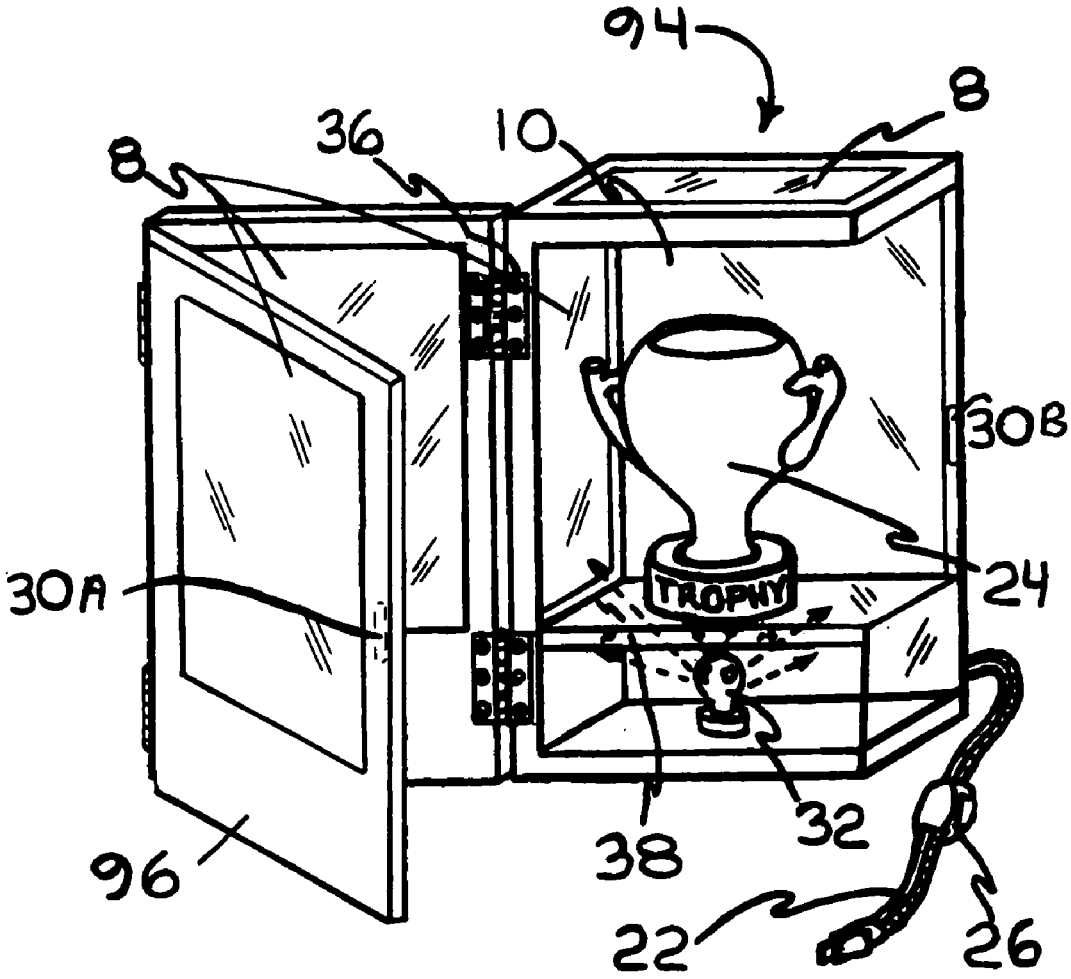
FIG. 12 is a perspective view of an eleventh preferred embodiment of the present invention having a rectangular housing and a multi-sided cover that separates from the stationary base member to give temporary access to the interior space defined by the stationary base member and the cover between infinity display uses.

FIGS. 1–8 show several box-like embodiments each with an openable front cover 6 containing one partially reflective surface or other reflective surface 8. Together FIGS. 1–8 show a variety of display objects 24, illumination means 18 and 32, and display object supports 34, 40, 84, 54, and 52 used with the box-like embodiments, and which could also be adapted for the other embodiments in FIGS. 9–12. In contrast, FIGS. 9–10 show two preferred embodiments that have a cover 76 with multiple reflective surfaces 8 that is vertically raised and lowered from its stationary base member 4 for the exchange of display objects 24. FIG. 11 shows a box-like embodiment with an openable front cover 6 containing more than one partially reflective surface or other reflective surface 8, and FIG. 12 shows a box-like embodiment with a cover 6 that is vertically raised and lowered from its stationary base member 4 for the exchange of display objects 24.

Figure 1:
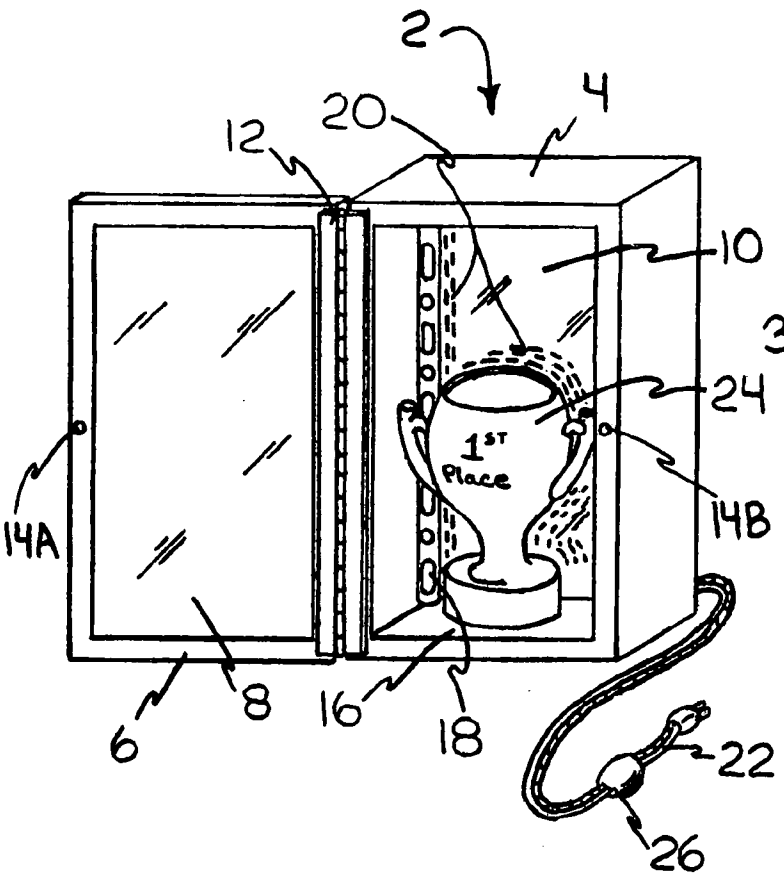
FIG. 1 is a front perspective view of a first preferred embodiment of the present invention having a rectangular housing with a box-like stationary base member and a totally reflective surface attached to its rear inside surface, a substantially planar cover hinged to one side of the stationary base member and comprising a partially reflective surface supported by a frame, closure means between the stationary base member and the cover, multiple lights vertically extending in opposed lateral positions within the interior space adjacent to the totally reflective surface, and one display object positioned within the interior space and being supported directly by the housing.

FIG. 1 shows a first preferred embodiment 2 of the present invention having a rectangular housing with a box-like stationary member 4 having five enclosed sides, an open sixth side, and a totally reflective surface 10 attached to its rear inside surface. Although not limited thereto, first preferred embodiment 2 would preferably be wall-mounted, with totally reflective surface 10 generally being in a position remote from an observer (not shown). Since it is contemplated for any commonly used type of wall mounting bracket or means to be attached to or used within the back surface of stationary base member 4 for securing it against a wall surface, and further since the number of mounting brackets or other type of mounting means used is also not critical, illustrations of the mounting hardware alternatives possible for wall attachment of first preferred embodiment 2 have not been provided. FIG. 1 also shows first preferred embodiment 2 having a substantially planar cover 6 attached to one side of stationary base member 4 with an elongated hinge 12. Although FIG. 1 shows one elongated hinge 12, the use of a single elongated hinge 123 is not critical and it is also considered to be within the scope of the present invention for first preferred embodiment 2 to have other types and sizes of connecting devices between cover 6 and stationary base member 4, including releasable fasteners such as magnetic fasteners 30*a* and 30*b* shown in FIG. 2, locking fasteners such as keyed fastener 44 shown in FIG. 3, supportive grooves, such as groove 48 shown in FIG. 4, and other similar devices that securely hold cover 6 against stationary base member 4 while at the same time are easily manipulated by a user for prompt separation of cover 6 from stationary base member 4. Also, the side of stationary base member 4 to which hinge 12 is attached is not critical, and as an alternative to the left perimeter edge of stationary base member 4 shown in FIG. 4, hinge 12 could also be attached to the right perimeter of stationary base member 4, its top perimeter edge wherein the bottom edge of stationary base member 4 would open in a forward and upwardly direction, or the bottom perimeter edge of stationary base member 4 wherein the top edge of cover 6 would open in a forward and downwardly direction. Since the infinity display effect requires a minimum of two mirrored surfaces, with at least one being partially reflective, FIG. 1 shows cover 6 comprising a partially reflective surface 8 centrally supported within a frame to complement the totally reflective surface 10 attached to the back interior surface of stationary base member 4 for infinity display effect purposes. Cover 6 would not need to be totally closed against stationary base member 4 for viewing an infinity display effect through partially reflective surface 6, however, the number of repeated images in the infinity display effect decreases as hinged cover 6 is rotated away from totally reflective surface 10. Although not shown in FIG. 1, but visible in FIG. 7 and identified by the number 86, it is contemplated and preferred for partially reflective surface 8 to be held securely within the frame of cover 6 by a minimum of four angular S-shaped mounting brackets 86, each in contact with partially reflective surface 8 and the frame of cover 6 near to their respective corners. However, although it is contemplated for angular S-shaped mounting brackets 86 to be used in first preferred embodiment 2, the use of angular S-shaped mounting brackets 86 is not critical, and it is considered within the scope of the present invention for other types and configurations of commonly used mirror-to-frame mounting brackets to be employed. When there is no illumination between partially reflective surface 8 and totally reflective surface 10, partially reflective surface 8 would reflect the image of an observer viewing it. However, when illumination does exist behind partially reflective surface 8, an observer would be able to see through partially reflective surface 8 and view illuminated objects positioned behind it, such as display object 24 in FIG. 1, which is shaped as a trophy and shown positioned directly on the bottom inside surface 16 of stationary base member 4. Since cover 6 is easily opened without disturbing stationary base member 4, display objects 24 would no need to be permanently secured or anchored within stationary base member 4, during their use in providing an infinity display effect. In the first preferred embodiment shown in FIG. 1, the left and right sides of stationary base member are unmarked as being opaque, with the sole partially reflective surface 8 used being a part of cover 6. However, variations of the first embodiment also considered within the scope of the present invention could include either the left or right side of stationary base member 4, or both, containing partially reflective surfaces 8, cover 6 containing more than one partially reflective surface 8, the top surface of stationary base member 4 containing a partially reflective surface 8, and even the back surface of stationary base member 4 containing a partially reflective surface 8 in place of totally reflective surface 10, particularly when a bottom positioned source of light is used, such as light source 32 shown in FIG. 2, instead of the elevated strand of multiple miniature lights 18 used in the first preferred embodiment 2.

Figure 5:
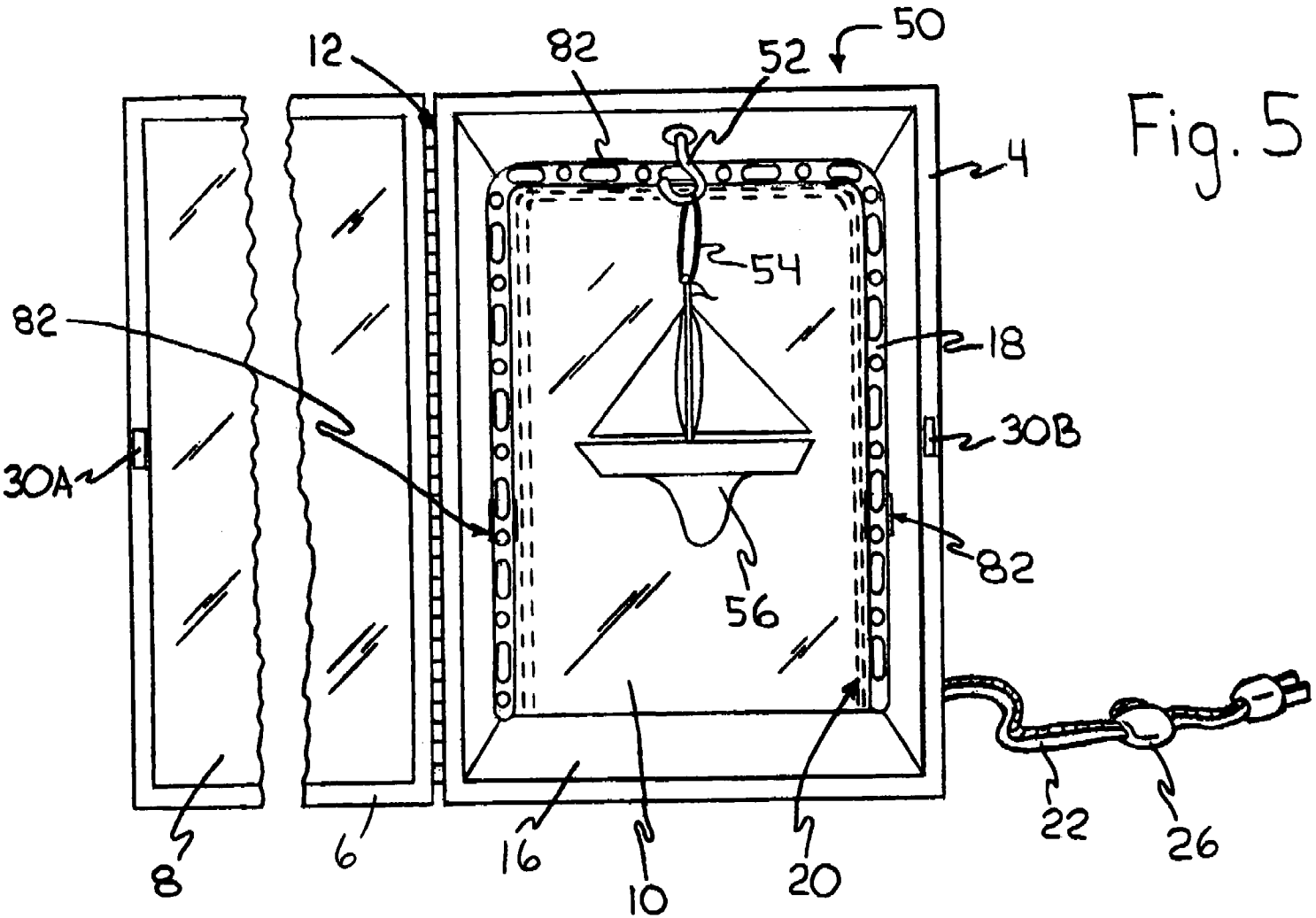
FIG. 5 is a front perspective view of a fourth preferred embodiment of the present invention having a rectangular housing with a box-like stationary base member and a mirror attached to its rear inside surface, a substantially planar cover hinged to one side of the stationary base member and comprising a frameless partially reflective surface, magnetic closure means positioned between the stationary base member and the cover, multiple lights positioned within the interior space defined by the stationary base member and the cover, and placed laterally against the totally reflective surface that is attached to the rear inside surface of the stationary base member, a hooked display object support device and cord adapted for suspending a display object within the interior space, and one suspended display object connected to the hooked display support device.

FIG. 1 also shows a two-part fastener consisting of first fastener 14*a* and second fastener 14*b* being use to achieve secure closure of cover 6 against stationary base member 4 when cover 6 is in its fully closed position. The type of fastening means used for first fastener 14*a* and second fastener 14*b* is not critical and any type or number of secure but easily opened closure means, such as a snap-fit type of closure, as well as locking closure means between the stationary base member 4 and cover 6, such a keyed fastener 44 in FIG. 3, are considered to be within the scope of the present invention as long as all are easily manipulated for prompt access to the interior space defined between stationary base member 4 and cover 6. A handle could optionally be positioned on the reverse side of cover 6 not visible in FIG. 1, anywhere along the distal edge of the frame of cover 6 in a position remote from hinge 12. However, generally a handle is not preferred and instead cover 6 can be made to slightly overlap the perimeter of stationary base member 4, at least one the perimeter edge of the frame of cover 6 that is remote from hinge 12, so as to provide an easily gripped hand-hold for manipulating cover 6 between it fully closed position and its fully opened position. FIG. 1 also shows a strand of multiple miniature lights 18 extending vertically along the left side of display object 24 in a position adjacent to the perimeter edge of totally reflective surface 10. Since no infinity mirror effect would be possible with cover in its fully opened position, only a single reflected image 20 of miniature lights 18 and display object 24 are shown behind them. Since it is preferred that miniature lights 18 would extend across the top perimeter edge of totally reflective surface 10, as well as along both vertically extending side perimeter edges, a reflected image 20 of miniature lights 18 is also shown to the right of display object 24, the miniature lights 18 on the right side of display object 24 remaining hidden from view behind stationary base member 4. Although not shown in FIG. 1 and not necessarily needed if a display support 34 is used beneath display object 25, similar to that shown in FIG. 2, since a display support 34 would preferably have small openings therethrough laterally on its back edge for securing the ends of miniature lights 18, in the first preferred embodiment 2 miniature lights 18 could be supported by several small transparent, translucent, or opaque U-shaped brackets 82, as shown in FIG. 5. Secure attachment of U-shaped brackets 82 to totally reflective surface 10 could be achieved by adhesive or bonding agent means (not shown). FIG. 1 also shows the electrical cord 22 needed for connecting miniature lights 18 to a source of electrical power (not shown) and an on-off switch 26 for use in activating miniature lights 18 for illumination of display object 24 and the instantaneous creation of an infinity mirror display effect when cover 6 is fully closed, or nearly closed, against stationary base member 4 and display object 24 is viewed through partially reflective surface 8. Although it is preferred for electrical cord 22 to extend through a small opening in the back surface of stationary base member 4 near to its bottom surface, and for on-off switch 26 to be conveniently positioned close to stationary base member 4 for easy access thereto, such connections are not critical. Further, although on-off switch 26 is show to have a rotating dick type of switch activation means for aesthetic purposes, it is considered to be within the scope of the present invention, although not shown, for on-off switch 26 to also have a toggle, depressible button, rotatable knob, or other type of electrical activation means.

The materials used for cover 6 and stationary base member 4 in first preferred embodiment 2 can vary, and although not limited thereto it is contemplated for the frame portion of cover 6 and stationary base member 2 to be made from rigid materials capable of respectively supporting totally reflective surface 10 and partially reflective surface 8, such as but not limited to wood, metal, plastic materials, ceramic materials, and the like. Although not show, the interior surfaces of stationary base member 4, other than the back interior surface to which totally reflective surface 10 is attached, can be lined with a fabric, such as felt, and/or other aesthetically pleasing materials. However, if such lining were used, although not limited thereto, they would generally consist of non-shiny fabrics in a variety of dark or subdued colors, unless needed for a particular use to enhance an infinity effect display effect. Also, although it is contemplated in first preferred embodiment 2 for totally reflective surface 10 and partially reflective surface 8 to be made from glass and for totally reflective surface 10 to be a conventional silvered mirror, it is considered to be within the scope of the present invention for totally reflective surface 10 and partially reflective surface 8 to comprise other reflective materials. Also in the first preferred embodiment 2 shown in FIG. 1, although totally reflective surface 10 and partially reflective surface 8 are shown to be substantially parallel to one another, positioning at oblique angles relative to one another can provide pleasing visual effects and therefore respective oblique positioning of totally reflective surface 10 and partially reflective surface 8 to the other is also considered to be within the scope of the present invention.

Although not limited thereto and provided herein only as an example, the dimensions of first preferred embodiment 2 for creating a pleasing infinity display effect with a display object having a height dimension of approximately four inches and a diameter dimension of approximately two-and-one-half inches, could include box-like stationary base member 4 having a width dimension of approximately ten inches, a height dimension of approximately twelve inches, and a depth dimension of approximately four inches. Corresponding dimensions for cover 6, which would provide a small amount of stationary base member overlap to create a hand-hold for easily opening cover 6 without the need for a handle, would include a width dimension of approximately ten-and-one-half inches, a height dimension of approximately twelve-and-one-half inches, and a depth dimension of approximately one-half of an inch. Cover 6 would have a centrally positioned opening with width and height dimensions respectively of approximately seven and nine inches, through which partially reflective surface 8 is used to view display objects 24 positioned within the interior space defined by cover 6 and stationary base member 4. To center the slightly larger cover 6 against stationary base member 4, hinge 12 would be attached between the rear surface of cover 6 and stationary base member 4, as is more clearly illustrated in FIG. 2, with hinge 12 generally hidden from an observer by the perimeter edge of cover 6. As an alternative to one elongated hinge 12 having a length dimension of approximately eleven inches, the first preferred embodiment could also comprise two smaller hinges 12 each having a length dimension of approximately one-and-one-half inches and a spaced-apart distance therebetween of approximately five inches. Also in the first preferred embodiment 2, partially reflective surface 8 would have width, length, and thickness dimensions respectively of approximately eight-and-one-half inches, ten-and-one-half inches, and one-fourth of an inch. Similarly, totally reflective surface 10 would also have width, length, and thickness dimensions respectively of approximately eight-and-one-half inches, ten-and-one-half inches, and one-fourth of an inch. If a supporting surface other than the bottom inside surface 16 of stationary base member 4 were used for display object 24, such as the display support 34 shown in FIG. 2, it would have approximate length, height, and depth dimensions respectively of approximately nine inches, one-and-one-half inches, and two-and-one-half inches. When a strand of miniature lights 18 are used against the top and side perimeter edges of totally reflective surface 10 for illumination of display objects 24 placed between totally reflective surface 10 and partially reflective surface 8, it is preferred for miniature lights 18 to have a maximum diameter dimension of approximately one-half inch. Also, when display support 34 is used with miniature lights 18, although not shown, it is contemplated that a small opening would be placed laterally through each back edge of display support 34 for the insertion therethrough of a different one of the opposing ends of miniature lights 18 to help secure miniature lights 18 in their usable position. In the first preferred embodiment 2 electrical cord 22 would be approximately four feet in length, with on-off switch 26 being connected to electrical cord 22 within a conveniently accessible distance of approximately eight inches from stationary base member 4. On-off switch 26 would preferably have a maximum length dimension of approximately one-and-one-half inches, and maximum width and depth dimensions of approximately one-half of an inch. On-off switch 26 would also preferably have one rotating disk for use in activating miniature lights 18, although other activation means such as a depressible button, rotatable know, or toggle switch (not shown) could also be used. When the above dimensions are used in first preferred embodiment 2, and an observer's line of sight is approximately directed to the top of display object 24, the infinity mirror display effect created rearwardly from display object 24 will extend nearly to the top perimeter edge of totally reflective surface 10.

Figure 2:
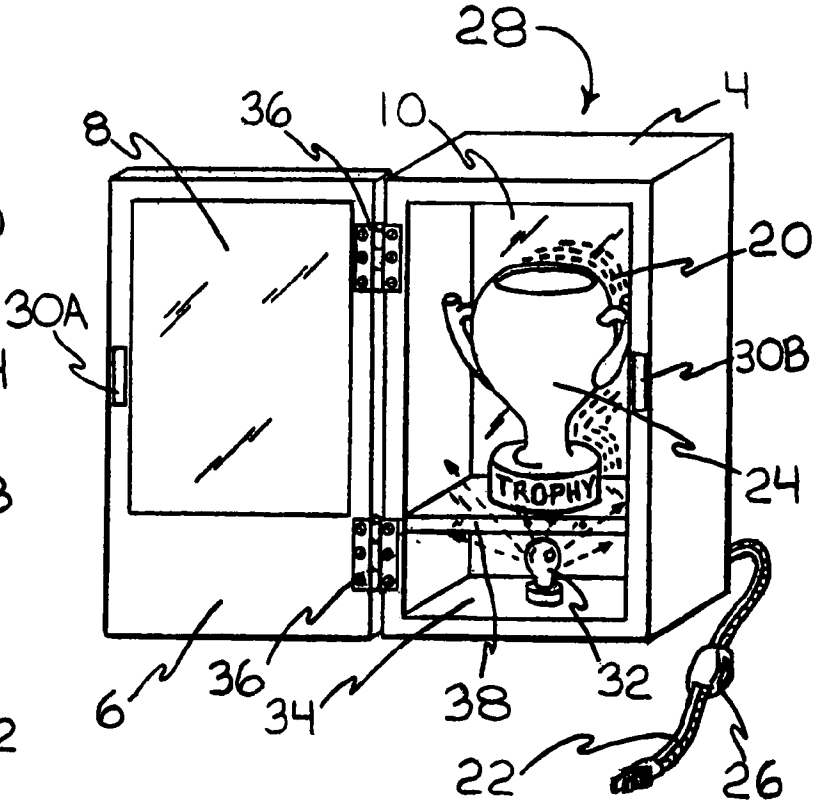
FIG. 2 is a front perspective view of a second preferred embodiment of the present invention having a rectangular housing with a box-like stationary base member and a totally reflective surface attached to its rear inside surface, a substantially planar cover hinged to one side of the stationary base member and comprising a partially reflective surface supported by a frame, magnetic closure means positioned between the stationary base member and the cover, a rectangular display support having a transparent or translucent upper surface and being positioned within the bottom part of the stationary base member, a light source positioned below the display support, and one display object placed directly on the upper surface of the display support.
Figure 3:
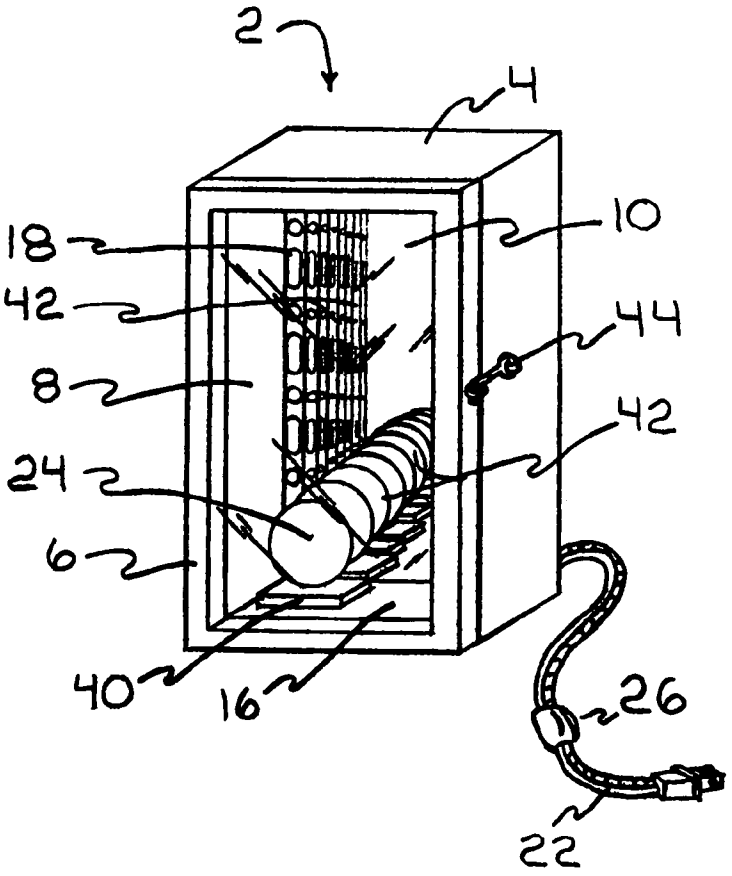
FIG. 3 is a front view of the first preferred embodiment of the present invention having its cover in a fully closed position, a locking closure means for the cover, a display object positioned upon a movable support member within the interior space defined by the box-like stationary base member and the cover, and multiple reflective images creating an infinity mirror effect extending rearwardly from the display object, the movable support member, and the multiple lights positioned laterally against the totally reflective surface that is attached to the rear inside surface of the stationary base member.

FIG. 2 shows a second preferred embodiment 28 of the present invention having a rectangular housing with a box-like stationary base member 4 and a totally reflective surface 10 attached to its rear inside surface, a substantially planar cover 6 connected with hinges 36 to one side of stationary base member 4 and comprising a partially reflective surface 8 supported by a frame, magnetic closure means 30A and 30B positioned between stationary base member 4 and cover 6, a rectangular display support 34 having a transparent or translucent upper surface 38 and being positioned within the bottom part of stationary base member 4, a light source 32 positioned below display support 32, and one display object 24 placed directly on the upper surface 38 of display support 34. Although multiple reflections 20 of display object 24 would only be observed with cover 6 in its closed position, reflections are shown in FIG. 2 for illustrative purposes only. In addition, FIG. 2 shows an electric cord 22 with and on-off switch 26 connected through stationary base member 4 for activation of light source 32. In contrast, FIG. 3 shows first preferred embodiment 2 of the present invention having its cover 6 comprising a partially reflective surface 8 in a fully closed position against stationary base member 4, a locking closure means 44 for cover 6, a display object 24 positioned upon a movable support member 40 within the interior space defined by box-like stationary base member 4 and cover 6, multiple lights 18, an electric cord 22 with and on-off switch 26 connected through stationary base member 4 for activation of multiple lights 18, and multiple reflective images 42 creating an infinity mirror display effect extending rearwardly from display object 24, movable support member 40, and the multiple lights 18 positioned laterally against the totally reflective surface 10 that is attached to the rear inside surface of stationary base member 4.

Figure 4:
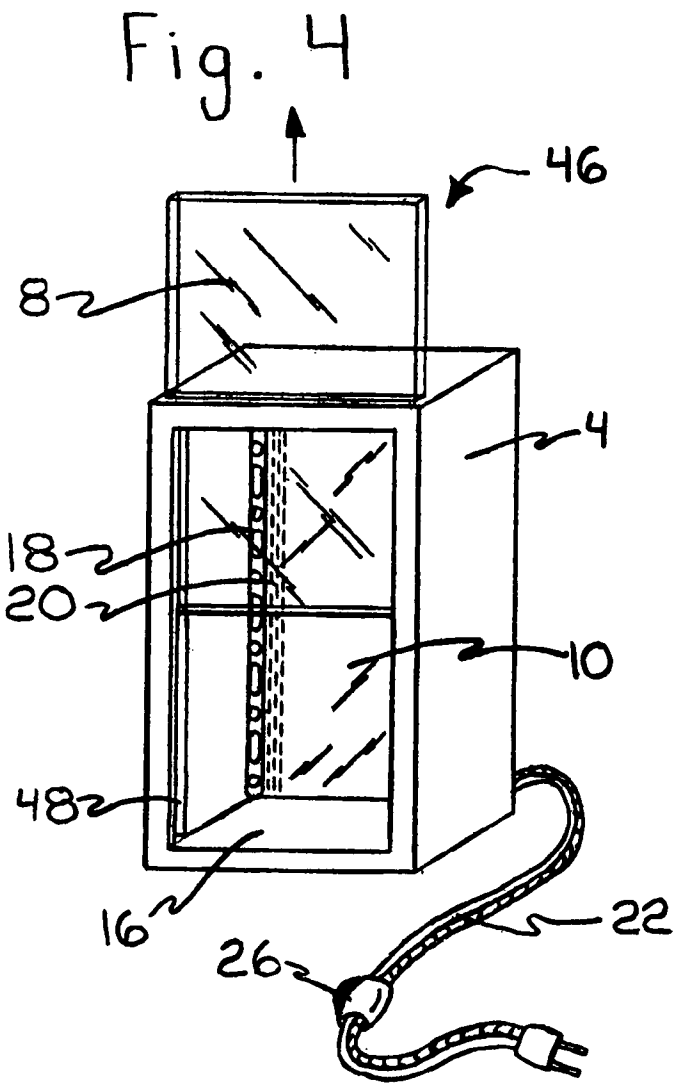
FIG. 4 is a front perspective view of a third preferred embodiment having a rectangular housing with a box-like stationary base member and a mirror attached to its rear inside surface, a substantially planar cover vertically slidable within grooves formed laterally in the stationary base member near to its front perimeter, the cover comprising a frameless partially reflective surface, and multiple lights positioned within the interior space defined by the stationary base member and the cover, and placed laterally against the totally reflective surface that is attached to the rear inside surface of the stationary base member.

FIG. 4 shows a third preferred embodiment 46 having a rectangular housing with a box-like stationary base member 4 and a fully reflective rear inside surface 10, a substantially planar cover comprising a frameless partially reflective surface 8 that is vertically slidable within grooves 48 formed laterally in stationary base member 4 near to its front perimeter, and multiple lights 18 positioned within the interior space defined by stationary base member 4 and the partially reflective surface 8 comprising a cover, with lights 18 placed laterally against the totally reflective surface 10 that is comprises the rear inside surface of stationary base member 4. FIG. 5 also reveals a fourth preferred embodiment 50 of the present invention having a rectangular housing with a box-like stationary base member 4 and a fully reflective rear inside surface 10, a substantially planar cover 6 hinged to one side of the stationary base member and comprising a frameless partially reflective surface 8, magnetic closure means 30A and 30B positioned between the stationary base member 4 and the cover 6, multiple lights 18 positioned within the interior space defined by stationary base member 4 and cover 6 and placed laterally against the totally reflective rear inside surface 10 of stationary base member 4 by U-shaped mounting brackets 82, and an electric cord 22 with and on-off switch 26 connected through stationary base member 4 for activation of multiple lights 18. What FIG. 5 shows being different from other illustrated embodiments of the present invention is a hooked display object support device 52 and cord 54 adapted for suspending a display object 24 within the interior space, and one suspended display object 24 connected to the hooked display support device 52 via cord 54.

Figure 7:
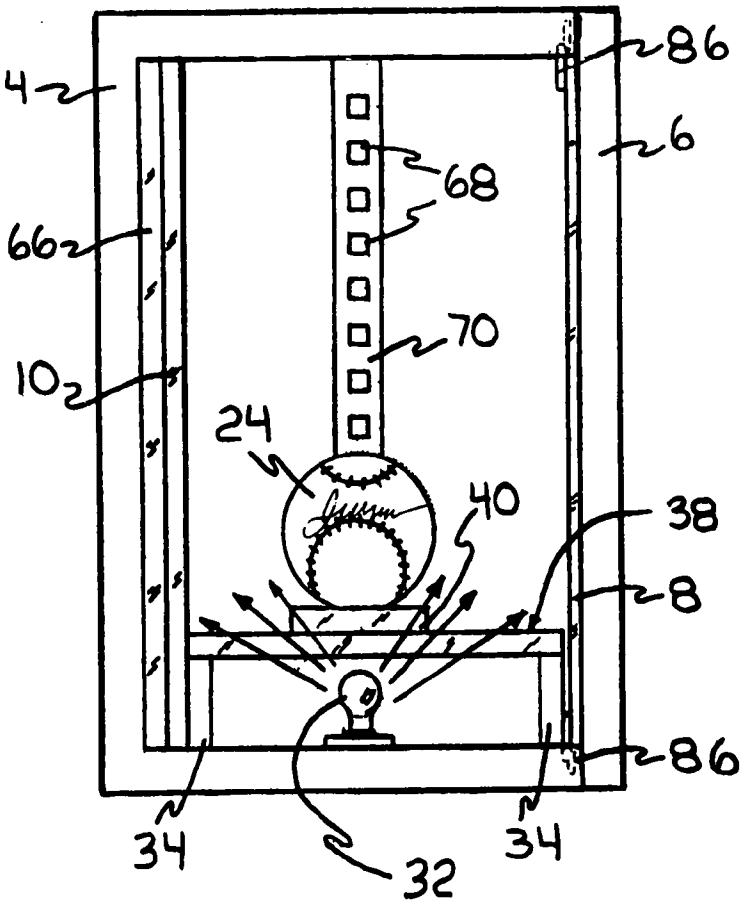
FIG. 7 is a left side view of a sixth preferred embodiment of the present invention having a housing with a box-like stationary base member and a reflective surface attached to its rear inside surface with its reflective side against the rear inside surface of the stationary base member, a substantially planar cover closed against the stationary base member and comprising a partially reflective surface supported by a frame, a display support having a transparent or translucent upper surface positioned in the bottom part of the stationary base member, a light source positioned under the display support, a display object positioned on top of a movable support member placed centrally upon the display support, and a vertically extending mounting strip on the wall of the housing behind the display object with holes therein for adjustable positioning of elevated support members having complementary protrusions for the optional elevated display of additional objects between the stationary base member and its cover.
Figure 6:
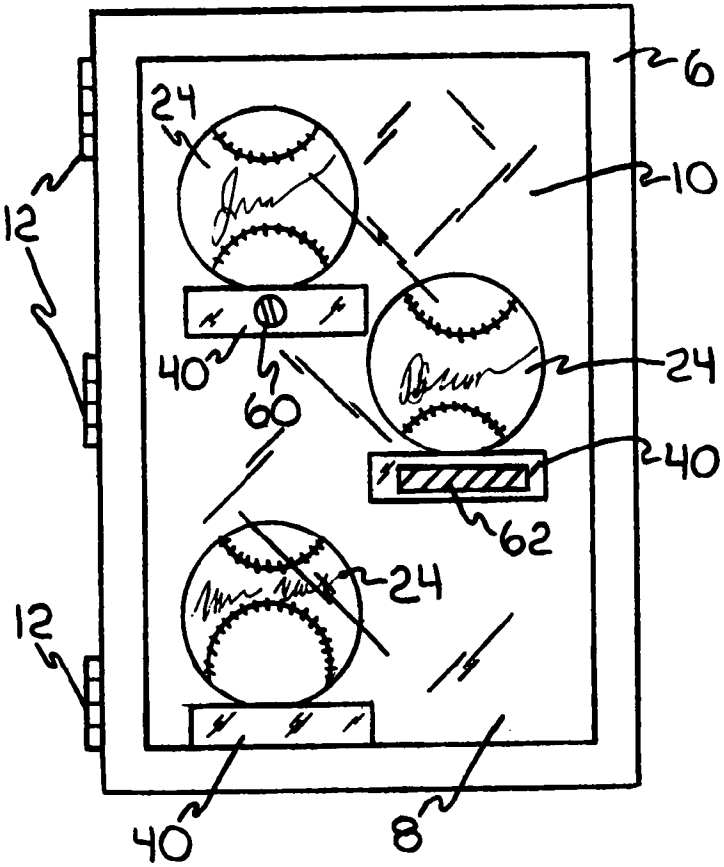
FIG. 6 is a front view of a fifth preferred embodiment of the present invention having a rectangular housing with a hinged front cover made from a partially reflective surface supported by a frame, the cover being in its fully closed position, a rearwardly positioned reflective surface, and three display objects positioned between the cover and the rearwardly positioned reflective surface, one of the display objects positioned upon a movable support member placed on the bottom interior surface of the housing, with two additional display objects each being positioned upon a movable support member, with one of the movable support members being attached to the partially reflective surface by suction cup means and the other movable support members being bonded to the partially reflective surface.
Figure 8:
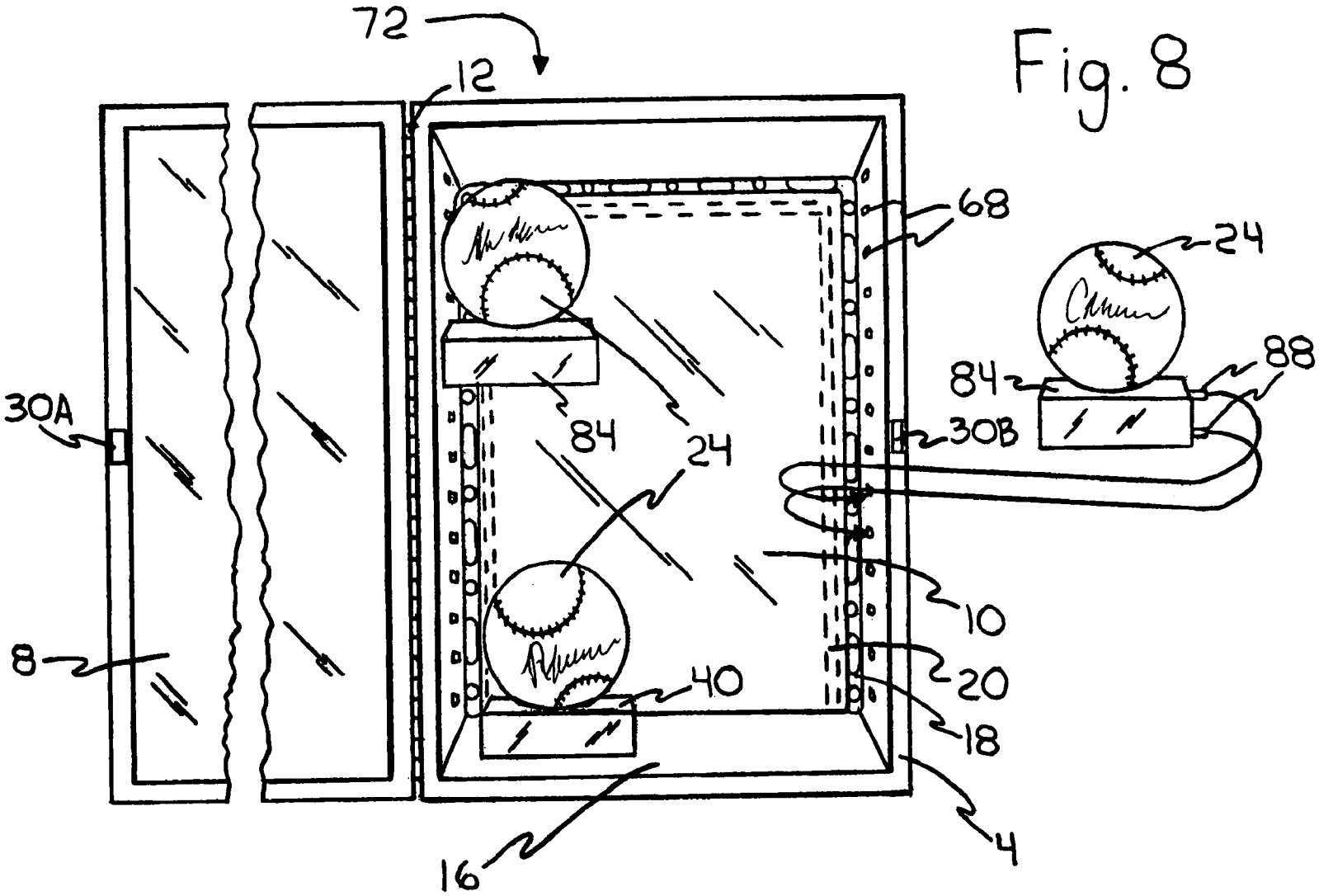
FIG. 8 is a front view of a seventh preferred embodiment of the present invention having a housing with a box-like stationary base member and a reflective surface attached to its rear inside surface, a substantially planar cover hinged to one side of the stationary base member and comprising a frameless partially reflective surface supported by a frame, two-part closure means for securely positioning the cover against the stationary base member when the cover is in its fully closed position, multiple lights positioned within the interior space defined by the stationary base member and the cover, three display objects positioned between the cover and the rearwardly positioned reflective surface, two opposed sets of vertically extending peg holes formed in the sides of the stationary base member with each set being on a different side of the display objects and adapted for adjustable positioning of elevated support members at different heights within the interior space, with one of the display objects being positioned upon a movable support member placed on the bottom interior surface of the housing, and a second display object being positioned upon an elevated support members attached to two peg holes on one side of the stationary base member, and a third display object positioned upon an elevated support member having protrusions and ready for connection to peg holes on the opposed side of the stationary base member.

In contrast, FIGS. 6–8 shows different means for supporting a display object 24 at elevation within the interior chamber defined by stationary base member 4 and cover 6. FIG. 6 shows a fifth preferred embodiment 58 of the present invention having a rectangular housing with a hinged front cover 6 made from a partially reflective surface 8 supported by a frame, with cover 6 being in its fully closed position, a rearwardly positioned fully reflective surface 10, and three display objects 24 positioned between cover 6 and fully reflective surface 10, one of the display objects 24 being positioned upon a movable support member 40 placed on the bottom interior surface of the housing, with two additional display objects 24 each being positioned upon a movable support member 40, with one of the movable support members 40 being attached to the partially reflective surface 8 by suction cup means 60 and the other movable support member 40 being attached with bonding means 62 to partially reflective surface 8. FIG. 7 shows a sixth preferred embodiment 64 of the present invention from its side and having a housing with a box-like stationary base member 4 and a fully reflective rear inside surface 10 with its reflective side against the rear inside surface of stationary base member 4, a substantially planar cover 6 closed against stationary base member 4 and comprising a partially reflective surface 8 supported by a frame, a display support 34 having a transparent or translucent upper surface 38 positioned in the bottom part of stationary base member 4, a light source 32 positioned under display support 34, a display object 24 positioned on top of a movable support member 40 placed centrally upon the display support 34, and a vertically extending mounting strip 70 on the wall of the housing behind the display object 24 with holes 68 therein for adjustable positioning of elevated support members 84 (shown in FIG. 8) having complementary protrusions 88 for the optional elevated display of additional objects between stationary base member 4 and cover 6 via mounting strip 70. FIG. 8 shows a front view of a seventh preferred embodiment 72 of the present invention having a housing with a box-like stationary base member 4 and a fully reflective rear inside surface 10, a substantially planar cover 6 attached with hinge 12 to one side of stationary base member 4 and comprising a frameless partially reflective surface 8 supported by a frame, two-part closure means 30A and 30B for securely positioning cover 6 against stationary base member 4 when cover 6 is in its fully closed position, multiple lights 18 positioned within the interior space defined by stationary base member 4 and cover 6, three display objects 24 positioned between cover 6 and the fully reflective surface 10, two opposed sets of vertically extending peg holes 68 formed in the sides of stationary base member 4 with each set being on a different side of the display objects 24 and adapted for adjustable positioning of elevated support members 84 at different heights within the interior space, with one of the display objects 24 being positioned upon a movable support member 40 placed on the bottom interior surface of the housing, and a second display object 24 being positioned upon an elevated support member 84 attached to two peg holes 68 on one side of stationary base member 4, and a third display object 24 positioned upon an elevated support member 84 having protrusions 88 and ready for connection to peg holes 68 on the opposed side of stationary base member 4.

FIG. 9 shows an eighth preferred embodiment 74 of the present invention having a hexagon-shaped housing with a substantially planar platform-like stationary base member 4 and a display support 34 with a transparent or translucent upper surface 38 positioned above stationary base member 4. FIG. 9 also shows eighth preferred embodiment 74 having a display object 24 being maintained in its designated display position by a hexagon-shaped movable support member 78 centrally upon upper surface 38. Miniature lights 18 are positioned under the perimeter of upper surface 38 and secured thereto by six U-shaped mounting brackets 82. The number of U-shaped mounting brackets 82 used is not critical, however it must be sufficient to maintain miniature lights 18 close to upper surface 38 to provide adequate illumination for display object 24 and creation of a pleasing infinity display effect. In the alternative, a light source 32, such as is shown in FIG. 10, could be used to illuminate display object 24. FIG. 9 also shows a box-like cover 76 poised over display object 24 and display support 34, that can be vertically lifted from stationary base member 4 to give access to the interior space defined by stationary base member 4 and cover 76 for the exchange of display object 24. In FIG. 9 cover 76 is shown comprising adjoining frameless partially reflective surfaces 8, which can include but are not limited to mirrors. Therefore, in the description of the present invention herein, the word mirror can be substituted for reflective surface, and the reverse. As a result, when first preferred embodiment 74 is table mounted, the infinity mirror display effect created with display object 24 can be viewed from a fully 360°. FIG. 9 also shows electrical cord 22 extending from the lower back surface of stationary base member 4 and on-off switch 26 in its preferred location close to stationary base member 4. For illustrative purposes, electrical cord 22 is shown in a shortened condition. Although not shown, it is contemplated in first preferred embodiment 74 for display objects 24 to be positioned for viewing upon elevated movable support members 84 secured by pegs holes 68 in mounting strips 70, or in the alternative upon movable support members 40 attached to the interior surfaces of one or more partially reflective surfaces 8 in cover 76 at differing heights by adhesive/bonding agents 62, as well as movable support members 40 secured directly to the interior surfaces of one or more partially reflective surface in cover 76 by suction cups 60 or adhesive/bonding agents 62, and suspension from filamentous materials 54 attached to anchoring devices 52 that are directly connected to the interior surface of one or more partially reflective surfaces in cover 76. Although box-like cover 76, display support 34, and platform-like stationary base member 4 are shown in FIG. 1 to have hexagonal configurations, the first preferred embodiment is not limited to hexagon-shaped configurations, and it is also contemplated for cover 76, display support 34, and stationary base member 4 to have other angular configurations, such as but not limited to octagonal, trapezoidal, and square. Also, FIG. 9 shows stationary base member 4 extending beyond display support 34 so that when cover 76 is placed in its closed position, cover 76 is positioned against stationary base member 4 and does not come in contact with the table, counter, or floor surface (not shown) positioned beneath stationary base member 4.

FIG. 10 shows a ninth preferred embodiment 80 of the present invention having a rectangular housing with a substantially planar platform-like stationary base member 4 and a light source 32 attached through the upper surface of stationary base member 4. FIG. 10 also shows ninth preferred embodiment 84 having a display support 34 with a transparent or translucent upper surface 38 poised above stationary base member 4, a display object 24 being retained in a fixed display position by a movable support member 40 centrally upon upper surface 38, and a box-like cover 76 that is vertically lifted from stationary base member 4 to give access to the interior space defined by stationary base member 4 and cover 76. In FIG. 10 cover 76 is poised over stationary base member 4 in an open position allowing for rapid exchange of display object 24. Also, the cover 76 shown in FIG. 10 comprises adjoining partially reflective surfaces 8 each supported by a frame and appearing like the cover 6 shown in FIGS. 1–3 and FIG. 6. FIG. 10 also shows electrical cord 22 extending from the lower back surface of stationary base member 4 and on-off switch 26 in its preferred location close to stationary base member 4. For illustrative purposes, electrical cord 22 is shown in a shortened condition. In FIG. 10, if stationary base member 4 is not configured to extend beyond display support 34, when cover 76 is placed in its closed position against stationary base member 4, stationary base member 4 would be positioned within cover 76 and cover 6 would come in contact with the table, counter, or floor surface (not shown) positioned beneath stationary base member 4. In such a position, although not shown, cover 76 would have a small aperture or cut-out for electrical cord 22. Display support 34 could be freely separable from stationary base member 4, or permanently secured thereto. When display support 34 is permanently secured to stationary base member 4, light source 32 would be exchanged through the bottom surface of stationary base member 4. Although it is contemplated for cover 76, display support 34, stationary base member 4, movable support members 40 to have any type of angular configuration, angular configurations are preferred since arcuate configurations do not always provide as pleasing an infinity mirror display effect. Also, no handle is contemplated for cover 76 in the ninth preferred embodiment 84 to assist in lifting it away from stationary base member 4, as handles often detract from the infinity mirror display effect created by display objects 24 positioned within the interior space defined between cover 76 and stationary base member 4.

FIG. 11 shows a tenth preferred embodiment 90 of the present invention having a rectangular housing with a totally reflective rear surface 10 and a front surface having a partially reflective surface 8, and two sides each having a partially reflective surface 8', as well as a light source 32 attached through the top end of stationary base member 4, which also serves as cover 6 and can be vertically lifted away from stationary base member 4, as shown by the upwardly directed arrow adjacent to the front left corner of cover 6, so as to give access to the interior space defined by stationary base member 4 and cover 6 for the exchange of display objects 24 Although cover 6 is shown as opaque, it could alternatively comprise a partially reflective surface 8. Also, totally reflective rear surface 10 could be replaced by a partially reflective surface 8. The number, relative positioning through the top end of stationary base member 4, type of lighting used, and configuration of light sources 32 are not critical, and one or more top mounted light sources 32 may be used, and may even be used in combination with light sources 32 and multiple lights 18 used within the interior space between stationary base member 4 and cover 6, as long as the total amount of light produced is adequate for an effective infinity mirror display effect. FIG. 11 also shows a display object 24 being supported atop a movable display support 40 and multiple images 42 extending rearwardly therefrom. In addition, FIG. 11 shows other reflected images 42 in broken lines, which indicates the diminished clarity and brilliant of reflected images 42 that typically are the result of a multiple reflective process occurring between several reflective and partially reflective surfaces 10, 8, and 8'. Further, if cover 6 is not made from a partially reflective material 8, it can have an interior surface that is totally reflective 10 for enhanced illumination of display objects 24 used to create an infinity display effect. When overhead illumination of display objects is used and the display objects are viewed from a partially reflective surface 8 in perpendicular orientation to top cover 6, the infinity display effect can be viewed while cover 6 is in an opened position, although when cover 6 also contains the source of illumination 32, as cover 6 is increasingly opened, the brilliance infinity display effect and quantity of reflected images 42 are diminished. Also, when the partially reflective surface 8 through which an observer (not shown) views display objects 24 is minimally reflective or transparent, an infinity display effect can still be seen when partially reflective surfaces 8' are laterally positioned relative to the minimally reflective or transparent viewing surface.

FIG. 12 shows an eleventh preferred embodiment 94 of the present invention having a rectangular housing and a multi-sided cover 96 that separates from the stationary base member 4 to give temporary access to the interior space defined by stationary base member 4 and cover 6 between infinity display uses. The cover 96 can be attached by hinges 36, or secured to the base member via quick-release fasteners 30A and 30B. Since the infinity display effect requires a minimum of two reflective surfaces 10 or 8, with at least one being partially reflective, FIG. 12 shows cover 96 comprising two partially reflective surfaces 8 centrally supported within a frame to complement the totally reflective surface 10 attached to the back interior surface of stationary base member 4 for infinity display effect purposes. FIG. 12 also shows the non-movable side of base member 4 having a partially reflective surface 8. Cover 6 would not need to be totally closed against stationary base member 4 for viewing an infinity display effect through partially reflective surface 8, however, the number of repeated images in the infinity display effect decreases as hinged cover 96 is rotated away from totally reflective surface 10. Although not shown in FIG. 12, it is preferred for each partially reflective surface 8 to be held securely within the frame of cover 6 by a minimum of four angular S-shaped mounting brackets 86, each in contact with partially reflective surface 8 and the frame of cover 6 near to their respective corners. However, although it is contemplated for angular S-shaped mounting brackets 86 to be used in first preferred embodiment 2, the use of angular S-shaped mounting brackets 86 is not critical, and it is considered within the scope of the present invention for other types and configurations of commonly used mirror-to-frame mounting brackets to be employed. Since cover 6 is easily opened without disturbing stationary base member 4, display objects 24 would not need to be permanently secured or anchored within stationary base member 4, during their use in providing an infinity display effect. Although not shown, variations of the eleventh embodiment also considered within the scope of the present invention could include either the left or right side of stationary base member 4, or both, containing partially reflective surfaces 8, cover 6 containing more than one partially reflective surfaces 8, the top surface of stationary base member 4 containing a partially reflective surface 8, and even the back surface of stationary base member 4 containing a partially reflective surface 8 in place of totally reflective surface 10, particularly when a bottom or top positioned source of light is used instead of a strand of multiple miniature lights 18. Further, although not shown, a handle could optionally be attached to cover 96 anywhere along the distal edge of the frame of cover 96 in a position remote from hinges 36. However, generally a handle is not preferred and instead cover 96 can be made to slightly overlap the perimeter of stationary base member 4, at least on the perimeter edge of the frame of cover 96 that is remote from hinges 36, so as to provide an easily gripped hand-hold for manipulating cover 6 between its fully closed position and its fully open position. Although it is preferred for electrical cord 22 to extend through a small opening in the back surface of stationary base member 4 near to its bottom surface, and for on-off switch 26 to be conveniently positioned close to stationary base member 4 for easy access thereto, such connections are not critical. Further, although on-off switch 26 is shown to have a rotating disk type of switch activation means for aesthetic purposes, it is considered to be within the scope of the present invention, although not shown, for on-off switch 26 to also have a toggle, depressible button, rotatable knob, or other type of electrical activation means.

What is claimed is:

1. An infinity mirror display apparatus for enhanced display of objects which allows easy and rapid exchange of one display object for another without having to dismantle said apparatus, disturb said apparatus from a mounted position, disturb other objects already positioned within said apparatus for display, or permanently alter objects to secure them for display, said infinity mirror display apparatus comprising:

a housing having a stationary base member and a cover which together define an enclosed interior space, said cover being easily movable between a closed position against said stationary base member and a variety of opened positions wherein rapid access to said interior space is provided;

at least two opposed at least partially reflective surfaces positioned adjacent to said interior space with two of said reflective surfaces being in opposed positions and at a spaced-apart distance from one another, with one of said reflective surfaces in opposed positions being partially reflective and positioned to provide front viewing of an infinity display effect, and the remaining ones of said reflective surfaces positioned to provide infinity display effect viewing selected from a group consisting of side viewing, back viewing, and top viewing;

a plurality of display objects adapted for positioning within said interior space, selected ones of said display objects being positioned between said two opposed partially reflective surfaces;

at least one light source communicating with said interior space and adapted for adequate illumination of each said selected display object for creation of multiple closely spaced-apart reflected images thereof to make an infinity mirror effect; and electrical connection means adapted for connecting each said light source to a source of power so that when electrical power is provided to each said light source, viewing of each said display object is enhanced by said infinity mirror effect to observers looking at said display object through each said partially reflective surface.

2. The apparatus of claim 1 further comprising a control means adapted for interrupting electrical power connection to each said light source.

3. The apparatus of claim 1 wherein said cover is selected from a group consisting of totally detachable covers, partially detachable covers, substantially planar covers, covers having more than one planar surface, covers having a top surface and four sides, covers having a partially reflective top surface, top opening covers, and covers with handles adapted for ease in cover manipulation between said open position and said closed position.

4. The apparatus of claim 1 wherein said stationary base member has a plurality of side surfaces, and said housings are selected from a group consisting of wall-mounted housings adapted for enhanced viewing of each said display object positioned therein with an infinity mirror effect viewed through said cover and said side surfaces, and table-mounted housings wherein a full 360° viewing of the infinity mirror effect is accomplished through said cover.

5. The apparatus of claim 1 wherein said stationary base member is selected from a group consisting of box-like stationary base members, platform-like stationary base members, and stationary base members having a partially reflective top surface.

6. The apparatus of claim 1 further comprising fastening means adapted for securing said cover against said stationary member when said cover is in said closed position.

7. The apparatus of claim 6 wherein said fastening means is selected from a group consisting of magnetic closure means, keyed locking means, and snap-fit types of closure means.

8. The apparatus of claim 1 further comprising at least one display object support device positioned within said interior space, said support device adapted for quick exchange of each said display object to and from said interior space, said support device also being adapted for support of at least one of said display objects without permanent alteration thereto.

9. The apparatus of claim 8 wherein each said display object support device is selected from a group consisting of transparent lower supports, translucent lower supports, opaque lower supports having at least one aperture therethrough, supports attachable to glass through suction cup means, means for suspending display objects within said interior space and support means comprising interlocking protrusions and peg holes.

10. The apparatus of claim 1 wherein each said light source is selected from a group consisting of incandescent bulbs, multiple miniature incandescent light bulbs encased within elongated flexible plastic tubing, neon lights, light emitting diode lighting, electroluminescent lights, lights positioned within said housing to shine upward on a display object, lights positioned within said housing to shine downward on a display object, and lights positioned within said housing to shine laterally toward a display object.

11. The apparatus of claim 1 wherein said stationary base member has opposed grooves therein adjacent to said interior space and said cover has opposed perimeter edges, and wherein said opposed perimeter edges of said cover are slidably positioned within said grooves for movement between said closed position and said opened positions.

12. A method of making an infinity mirror display apparatus providing easy access to the interior thereof for rapid exchange of display objects positioned therein without having to dislodge said apparatus from its mounted position, without having to dismantle said apparatus, without disturbing other display objects within said apparatus, and without requiring permanent alteration or modification of the display objects to securely position them within said apparatus, said method comprising the steps of:

providing a housing having an interior spaced defined by a stationary base member and an easily separable cover, at least one totally reflective surface, a plurality of partially reflective surfaces, a plurality of display objects adapted for positioning independently or in combination with one another within said interior space, at least one light source, electrical connection means, and a power source;

attaching a first one of said partially reflective surfaces to said cover in a position where said partially reflective surface is adjacent to said interior space and also so that an illuminated object positioned behind said partially reflective surface can be viewed by an observer looking through said partially reflective surface;

positioning a remaining one of said reflective surfaces adjacent to said interior space so that a reflected image from an illuminated object positioned behind said partially reflective surface can be viewed by an observer looking through said partially reflective surface;

positioning selected ones of said display objects within said interior space and between the ones of said reflective positioned adjacent said interior space;

positioning each said light source for communication with said interior space in a position remote from each said partially reflective surface used and also in a position to provide sufficient illumination for at least one of said display objects so that multiple reflected images of all of said display objects selected for positioning within said interior space can be seen through said partially reflective surfaces;

optionally forming an opening within said stationary base member and said cover for extension therethrough of said electrical connection means; and using said electrical connection means to connect each said light source to said power source so that when each said light source is activated, each of said selected display objects viewed through one of said partially reflective surfaces positioned adjacent to said interior space is enhanced by said multiple reflected images creating an infinity mirror effect.

13. The method of claim 12 wherein said stationary base members and complementing ones of said covers are selected from a group consisting of box-like stationary base members and substantially planar covers; substantially planar platform-like stationary base members and box-like covers; top opening covers; covers having two adjoined panels and a complementary stationary base member having top, bottom, and back surfaces; covers having three adjoined panels and a complementary stationary base member having top, bottom, and back surfaces; and stationary base members and a complementary cover each having an angled three dimensional configuration complementing the other to form an interior space, covers having a partially reflective top surface, and stationary base members having a partially reflective top surface.

14. The method of claim 12 further comprising the providing of a means of closure between said stationary base member and said wherein said means of closure is selected from a group consisting of hinges, easily releasable closure means, promptly releasable closure means, snap-fit types of closure means, magnets, and locking closure means.

15. The method of claim 12 further comprising display object support means and wherein said display object support means are selected from a group consisting of display supports having a transparent upper surface, display supports having a translucent upper surface, movable display support members, movable display support members secured in place by at least one suction cup, movable display support members secured in place by adhesive means, and movable display support members secured in place by bonding agent means.

16. The method of claim 12 further comprising the steps of providing a plurality of vertically extending spaced-apart peg holes and providing a plurality of elevated support members each having at least one protrusion thereon configured for engaging one of said peg holes.

17. The method of claim 16 wherein said step of providing a plurality of vertically extending spaced-apart peg holes is achieved through steps in a group consisting of the step of providing of a plurality of mounting strips having peg holes, connecting selected ones of said mounting strips in a vertical orientation to said stationary base member so that each of said mounting strips so mounted is positioned within said interior space, connecting selected ones of said mounting strips in a vertical orientation to said cover so that each of said mounting strips so mounted is positioned within said interior space, forming a plurality of peg holes which are spaced apart from one another directly within said stationary base member so that a device mating with any of said peg holes becomes positioned within said interior space, and forming a plurality of peg holes which are uniformly spaced apart from one another directly within said stationary base member so that a device mating with any of said peg holes becomes positioned within said interior space.

18. The method of claim 12 further comprising the steps of providing of a plurality of anchoring devices, providing a quantity of filamentous material, attaching a selected number of said anchoring devices to said stationary base member, securing at least a portion of said filamentous material to at least one of said display objects to create suspendable display objects, and rapidly connecting said filamentous material to at least one of said anchoring devices so as to freely hang each said suspendable display object within said interior space.

19. The method of claim 12 wherein said light source is selected from a group consisting of individual incandescent bulbs, incandescent miniature lights housed within a flexible plastic tubing, light emitting diodes, electroluminescent lights, and neon lighting.

20. The method of claim 12 wherein said stationary base member has opposed grooves therein adjacent to said interior space and said cover has opposed perimeter edges, and wherein said opposed perimeter edges of said cover are slidably positioned within said grooves for movement between said closed position and said opened positions.

* * * * *